United States Patent [19]

Kaufman

[11] 3,981,283

[45] Sept. 21, 1976

[54] ENGINE EXHAUST GAS RECIRCULATING CONTROL

[75] Inventor: Warren F. Kaufman, Santa Ana, Calif.

[73] Assignee: Ford Motor Company, Dearborn, Mich.

[22] Filed: Sept. 3, 1974

[21] Appl. No.: 502,523

[52] U.S. Cl. ..... 123/119 A
[51] Int. Cl.[2] ..... F02M 25/06
[58] Field of Search ..... 123/119 A

[56] References Cited

UNITED STATES PATENTS

| | | | |
|---|---|---|---|
| 2,722,927 | 11/1955 | Cornelius | 123/119 A |
| 3,641,989 | 2/1972 | Hill | 123/119 A |
| 3,739,797 | 6/1973 | Caldwell | 123/119 A X |
| 3,768,452 | 10/1973 | Lewis | 123/119 A |
| 3,861,642 | 1/1975 | Maddocks | 123/119 A X |

*Primary Examiner*—Wendell E. Burns
*Attorney, Agent, or Firm*—Robert E. McCollum; Keith L. Zerschling

[57] ABSTRACT

A motor vehicle type engine has an exhaust gas crossover passage connecting exhaust gases to the intake manifold below the carburetor and past a selectively operable, valve type sonic flow metering control that provides very accurate and reproducible measurements of the exhaust gas flow at all times, the control comprising a variable area convergent-divergent nozzle that is so designed and constructed as to provide sonic flow of the gases through the metering area over essentially the entire operating range of the engine manifold vacuum regardless of the change in metering area, thereby providing a constant flow rate for each changed area of the nozzle, with variances in the flow rate being in direct proportion to the change in metering area.

7 Claims, 3 Drawing Figures

ENGINE EXHAUST GAS RECIRCULATING CONTROL

Figure 1:
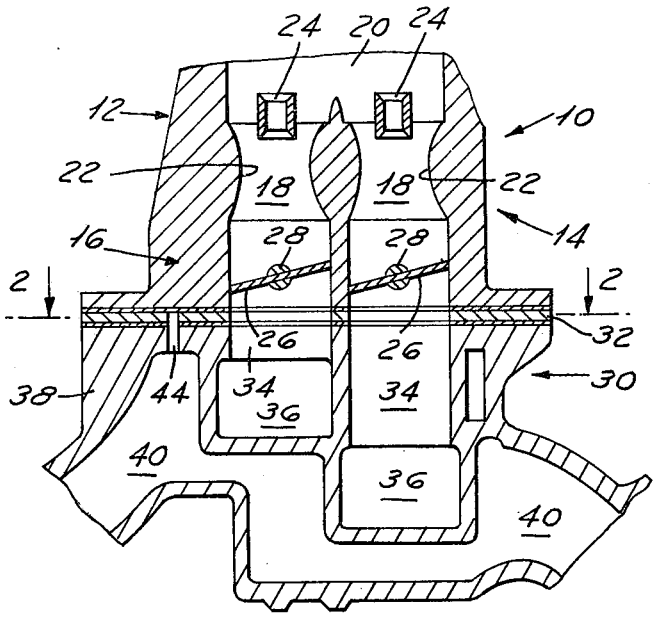

This invention relates, in general, to an internal combustion engine exhaust gas recirculating control. More particularly, it relates to a sonic flow device that provides very accurate and reproducible metering of exhaust gas flow regardless of the change of rate of flow, and, therefore, provides more accurate control of emission output.

Devices are known for recirculating a portion of the engine exhaust gases back through the engine to control the output of oxides of nitrogen. These devices generally have included poppet or butterfly type valves that are movable in response to certain conditions of operation of the engine to admit or block flow of the gases. Generally, flow past the open valves occurs at subsonic velocities, which usually does not provide maximum flow through the area, and which requires two pressure measurements and a subsequent nonlinear flow computation to be performed to determine the flow rate at that particular valve setting. The maximum flow rate that can occur through a metering element is achieved when sonic gas velocity is obtained. With poppet and butterfly type valves, however, it is only at certain large pressure differentials, that is, input to output pressure ratios at the higher vacuum force levels, that the flow becomes sonic and, therefore, constant. This is not too practical, however, since at higher vacuum levels little exhaust gas is desired to be recirculated. With sonic flow, the rate of flow is directly proportional to the flow area, and requires only one pressure measurement for metering. Sonic flow area variation further provides the capability for variable flow sonic metering.

It is, therefore, a primary object of this invention to provide a variable sonic flow metering device to provide precise and reproducible exhaust gas flow metering while also maintaining this precise metering over substantially the entire engine intake manifold operating range, from high values of vacuum force down to near atmospheric pressure levels.

More specifically, it is an object of this invention to provide an engine exhaust gas recirculating control consisting of a variable sonic flow metering device that provides different rates of flow of exhaust gas as neceessitated by changes in operation of the engine, the rates of flow, however, remaining constant at each open position of the valve to provide very accurate and reproducible metering of the flow in accordance with demands.

It is a still further object of the invention to provide an engine exhaust gas recirculating control consisting of a sonic flow metering device defined by a variable area convergent-divergent nozzle in which is axially movable in pintle so dimensioned and constructed with respect to the nozzle as to provide sonic velocity through the annular flow area between the pintle and nozzle over essentially the entire operating range of the intake manifold vacuum thereby providing accurate and reproducible measurements of the exhaust gas flow regardless of the flow rate required.

Figure 2:
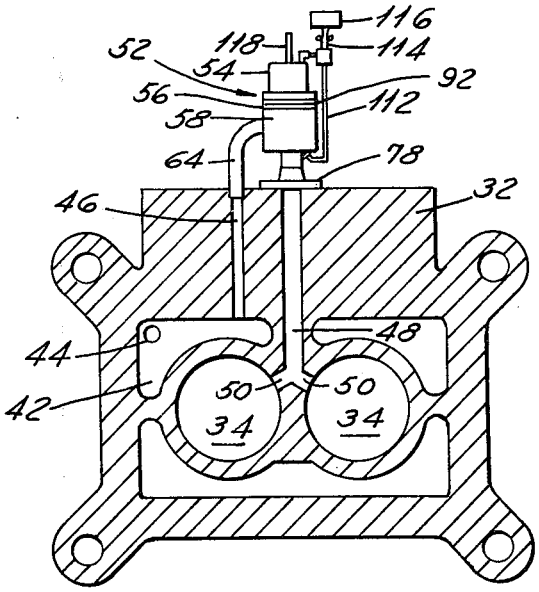
Figure 3:
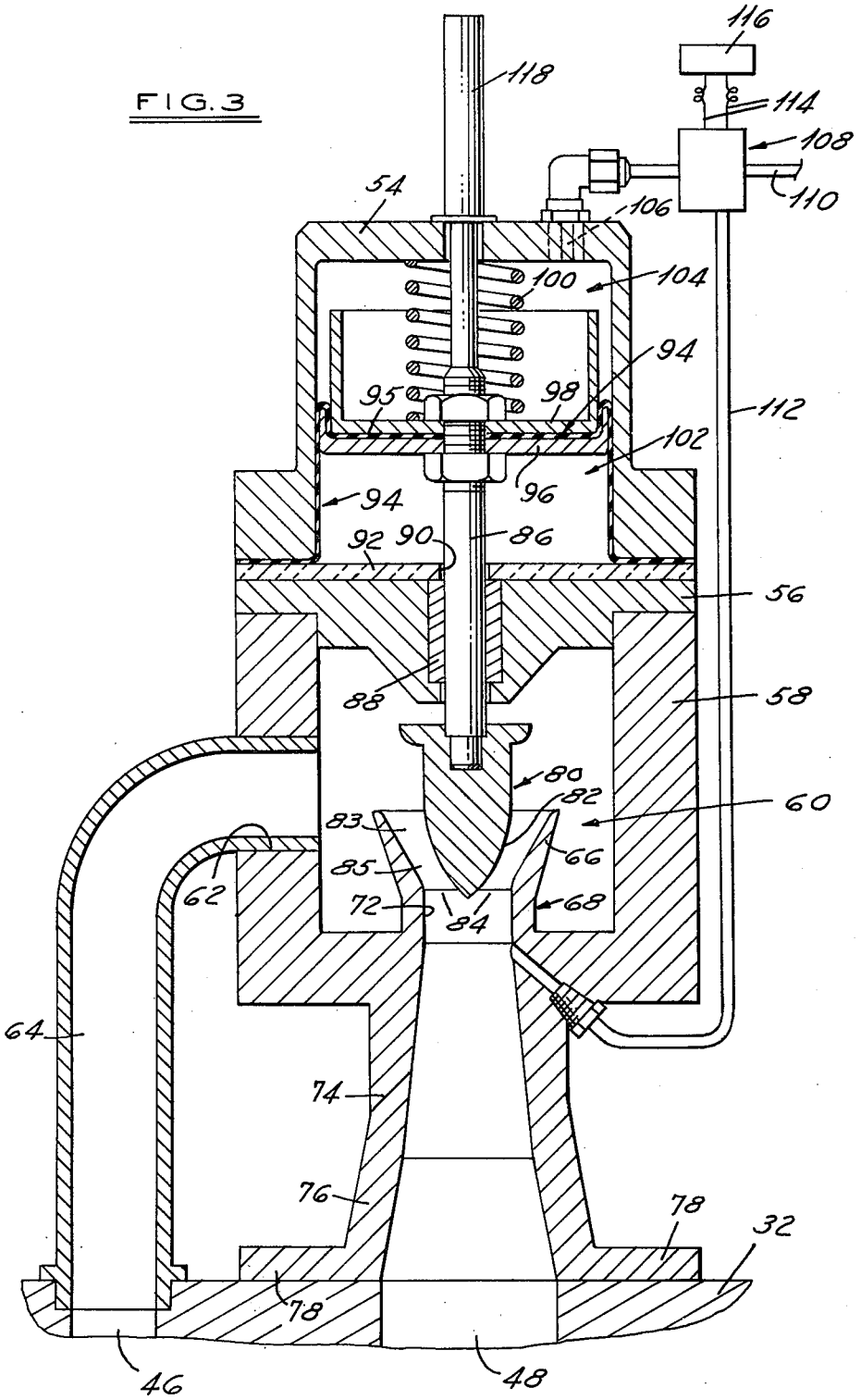

Other objects, features and advantages of the invention will become more apparent upon reference to the succeeding detailed description thereof, and to the drawings illustrating the preferred embodiment thereof; wherein, FIG. 1 is a cross-sectional view of a portion of an internal combustion engine manifolding on which is mounted a carburetor and which embodies the invention;

FIG. 2 is a cross-sectional view taken on the plane indicated by and viewed in the direction of the arrows 2—2 of FIG. 1; and FIG. 3 is an enlargement of a detail of FIG. 2, with parts broken-away and in section.

FIG. 1 illustrates a portion 10 of one-half of a two barrel carburetor of a known downdraft tvpe. It has an air horn section 12, a main body portion 14, and a throttle body 16, joined by suitable means not shown. The carburetor has the usual air/fuel induction passages 18 open at their upper ends 20 to fresh air from the conventional air cleaner, not shown. The passages 18 have the usual fixed area venturies 22 cooperating with booster venturies 24 through within the main supply of fuel is induced, by means not shown.

Flow of air and fuel through induction passages 18 is controlled by a pair of throttle valve plates 26 each fixed on a shaft 28 rotatably mounted in the sidewalls of the carburetor body.

The throttle body 16 is flanged as indicated for bolting to the top of the engine intake manifold 30, with a spacer element 32 located between. Manifold 30 has a number of vertical risers or bores 34 that are aligned for cooperation with the discharge ends of the carburetor induction passages 18. The risers 34 at their lower ends 36 extend at right angles for passage of the mixture out of the plane of the figure to the intake valves of the engine.

The exhaust manifolding part of the engine cylinder head is indicated partially at 38, and includes an exhaust gas crossover passage 40. The latter passes from the exhaust manifold, not shown, on one side of the engine to the opposite side beneath the manifold trunks 36. This provides the usual "hot spot" beneath the carburetor to better vaporize the air/fuel mixture.

As best seen in FIG. 2, spacer 32 is provided with a worm-like recess 42 that is connected directly to crossover passage 40 by a bore 44. Also connected to passage 42 is a passage 46 adapted alternately to be blocked or connected to a central passage 48. Passage 48 communicates with risers 34 through a pair of ports 50. Mounted to one side of spacer 32 is a valve assembly 52 that controls the interconnection between passages 46 and 48.

It is desirable to provide such a control as 52 to prevent the recirculation of exhaust gases at undesirable times. At engine idle, for example, exhaust gas scavenging is inefficient, while at wide-open throttle position, maximum power is limited by the availability of oxygen. At these times therefore, passage 46 normally should be closed. It should be opened, however, as a function of the change in load so that exhaust gases flow most when emission output is likely to be the greatest.

The above objectives are accomplished by valve assembly 52, which is shown more clearly enlarged in FIG. 3. More specifically, the valve assembly includes an upper hat-shaped section 54, an intermediate section 56, and a lower main body valve portion 58, all joined by suitable means not shown. The intermediate and lower portions 56 and 58 together define a gas chamber 60 that has an exhaust gas inlet port 62. The latter is connected by suitable tubing 64 to passage 46 in spacer 32.

Projecting into chamber 60 as an integral part of body portion 58 is the open-mouthed end 66 of a variable area convergent-divergent sonic flow metering nozzle or valve means 68. The nozzle includes the converging portion 66, an annular minumum area section 72, a first stage diffuser section 74 forming a portion of the divergent section, and a second stage diffuser portion 76. The latter is formed with flanges 78 for attachment to the side of spacer body portion 32 over passage 48, as shown. Cooperating with the inlet converging portion 66 is an axially movable pintle member or plug 80 with arcuate surfaces 82 suitably curved as shown. The surfaces together with the nozzle walls define annular converging and diverging flow areas 83 and 84 interconnected by a throat portion 85 of minumum cross-sectional area, as shown.

Pintle member 80 is secured on the end of a shaft 86 that is axially and variably movable. The shaft can be moved downwardly to one extreme position seating pintle 80 in nozzle 68 and completely blocking flow through the nozzle. Shaft 86 also can be moved upwardly to other open positions permitting varying volumes of exhaust gas flow through the nozzle. Shaft 86 is mounted for movement through a combination self-lubricating bushing and seal member 88 and an aperture 90 through an annular insulating disc 92. The insulation is used to prevent the high heat, 1200°–1300°F., for example, of the exhaust gases from deteriorating the actuator for shaft 86. The actuator in this case is a rolling type annular flexible diaphragm 94. The outer edges of the diaphragm are secured between upper body portion 54 and insulation 92. The central portion 95 of the diaphragm is secured between first and second cup-shaped annular retainers 96 and 98 fixed to shaft 86, as indicated. The two retainers together with diaphragm 94 slide axially within upper housing 54. They constitute the piston-like portion of a servo mechanism for actuation of movable pintle 80. A spring 100 biases the piston assembly downwardly towards the nozzle closing or flow blocking position.

Diaphragm 94 divides the hollow interior of upper body portion 54 into an air chamber 102 and a vacuum chamber 104. Air chamber 102 is vented to the atmosphere through a hole not shown. Vacuum chamber 104 is adapted to be connected alternately to a source of vacuum or to atmospheric air by means of a ported connection 106 and a three-way valve 108. The valve has inlet connections to an atmospheric air inlet line 110 and a vacuum inlet line 112. The latter is connected as shown to the high velocity section of the nozzle so as to be subject to the changing intake manifold vacuum level therein.

The specific details of construction of valve 108 are not given since they are conventional and known and believed to be unnecessary for an understanding of the invention. Suffice it to say that valve 108 is movable to a first position connecting air at atmospheric pressure from line 110 to chamber 104, a second position connecting the vacuum in line 112 from the nozzle to chamber 104 to move pintle 80 against the force of spring 100 to enlarge the nozzle flow area, and a third null position in which both air and vacuum lines are disconnected from the inlet connection 106. Valve 108 is shown in this case as being connected electrically by wiring 114 to a pilot or control device indicated schematically at 116. The latter is adapted to be responsive to predetermined conditions of operation of the engine such as accelerations, idling, etc., for example, to shift valve 108 between its various positions.

For example, the control 116 could be connected to an on-board type computer that would send signals to valve 108 for the valve to close the nozzle when the engine is idling or at wide open throttle and no exhaust gas recirculation is desired. Valve 108 would be moved to direct air to chamber 104 to permit spring 100 to completely shut the nozzle opening. Likewise, when the vehicle is being lightly accelerated and the emission level output increases, it would be desirable to increase exhaust gas recirculation in proportion to the load. Accordingly, a signal would be sent to valve 108 to open the vacuum connection from line 112 to chamber 104 to move the pintle 80 upwardly to a position providing the desired flow volume. Of course, alternate or nonelectronic controls could be provided for moving the pintle. In the prior art constructions, changes in manifold vacuum as controlled by the position of the conventional throttle valve have been used as a source of vacuum varying with load for actuating the exhaust gas recirculating valve. 118 indicates schematically a position transducer or feed back signal device. The device would in this case record the position of shaft 86 as it moves and relays this information to the control 116. Corrective signals then would be sent to the valve 108 to move it to the null or other position as required to insure stoppage of the piston assembly in the position called for in response to the engine operation at that time.

As started previously, nozzle 68 together with pintle or plug 80 constitutes a variable area convergent-divergent flow metering valve device. In this case, the entrance angles of the converging section and the curvature of the pintle surfaces 82 are so dimensioned and proportioned as to provide sonic flow velocities through the annular area between the two over essentially the entire operating range of intake manifold vacuum level changes. Therefore, when the engine is running thereby providing a pressure differential between passage 46 and the intake manifold, the subsonic exhaust gas flow into the converging portion 66 of the nozzle will increase in velocity to a sonic level at the throat or minimum annular area portion 85 between the nozzle and pintle.

As is well known, for a given flow area, flow at sonic velocity through that area will be constant. By careful design of the nozzle diffuser angles to avoid untimely separation of the flow and therefore turbulence and eddies resulting in pressure and other losses, sonic flow can be maintained over essentially the entire operating range of the intake manifold vacuum. That is, sonic flow can be maintained at high downstream to upstream pressure ratios, such as a value of 0.9, for example, due to an efficient diffuser section. This is in contrast to the use of poppet or butterfly type metering valves, where a pressure ratio of 0.5 would be required to achieve critical or sonic flow, which is impractical.

Each movement of pintle 80 will of course provide a new rate of flow through the changed annular area 85 between the pintle and nozzle; however, since the flow remains at sonic velocity, by the design of the nozzle and pintle, the flow rate will remain constant for each position. The overall flow rate, therefore, varies in direct proportion to the metering area, and, therefore, the position of the pintle, and provides a very accurate and reproducible metering device for measuring flow at any particular time. By way of illustration, the first stage diffuser might have, for example, 6° half angle divergences as measured from the longitudinal axis of the pintle, while the second stage diffuser angles could be larger with, say, 10° half angles since the velocity at this point has slowed to where the larger angle will not cause stall or separation of the flow stream providing turbulence. Maximum pressure recovery, therefore, can be obtained. It will be understood, of course, that with a sonic flow nozzle, that as the pressure downstream of the nozzle decreases, the sonic velocity at the throat section will increase to supersonic downstream of the throat, and pressure recovery will be obtained by means of a shock wave reducing the flow velocity to subsonic and substantially increasing the pressure, to the desired value. The lower the desired outlet pressure, the more the shock wave will be moved downstream before the increases in pressure across the shock wave is sufficient to provide the outlet pressure desired.

The operation is believed to be clear from the above description and a consideration of the drawing, and, therefore, will not be given in detail. When the engine is in an idle speed condition, control 116 will signal valve 108 to direct air from line 110 into servo chamber 104, permitting spring 100 to completely or nearly close the nozzle, as desired, by moving pintle 80 to a seated position. As the vehicle accelerator pedal is depressed, control 116 will send another signal to valve 108 to shift the position of the valve until vacuum in line 112 is directed to chamber 104. The pintle 80 accordingly will be moved upwardly to a position until the feedback position transducer 118 attached to pintle shaft 86 sends a signal to the control 116 that the pintle has reached the desired position. Valve 108 then will move to the null position. Regardless of what position the pintle 80 assumes, however, as stated previously, the particular rate of flow of exhaust gas attained in that position will remain constant so long as the pintle stays in that position. As the load or acceleration demand changes, the exhaust gas recirculation flow rate will also change. The pintle 80 will be moved upwardly or downwardly as the case may be to accordingly change the metering area and therefore the rate of flow through the nozzle. Again, however, since the flow remains at sonic velocity, the flow rate will be repeatable and accurately measurable.

From the foregoing, therefore, it will be seen that the invention provides a very accurate control for measuring the flow of exhaust gases into the intake manifold, regardless of the variances in metering area, which results in a precise control of emission output not found in conventional exhaust gas recirculating constructions using poppet or butterfly type valves with their usual subsonic flow velocities. The mass flow rate of gas in the construction of the invention varies only as a function of the displacment of the metering pintle, and remains constant so long as the metering area remains the same.

While the invention has been described and illustrated in its preferred embodiment, it will be clear to those skilled in the arts to which it pertains that many changes and modifications may be made thereto without departing from the scope of the invention.

I claim:

1. An exhaust gas recirculating flow metering control for an internal combustion engine having a duct connecting engine exhaust gases to the engine intake manifold, the control including a movable valve means associated with the duct and postioned to normally close the duct to prevent recirculation of the exhaust gases and movable to open positions to permit variable recirculation of the gases, and spring means biasing the valve means towards a duct closing position, the valve means including sonic flow metering means which in each open position of the valve means maintains flow past the valve means at a constant rate independent of the pressure variation in the duct downstream of the valve means, and actuator means connected to the valve means and movable in response to predetermined conditions of operation of the engine to move the valve means to a different open piston to change the rate of flow of exhaust gases into the intake manifold, the valve means including a sonic flow nozzle having a contoured pintle mounted therein, means mounting the nozzle and pintle for a relative axial movement therebetween the closed and open pistons of the valve means, the nozzle and pintle being so constructed and arranged as to define in the open positions of the valve means first a converging flow area between the nozzle and pintle followed by a gradually diverging flow area between the nozzle and pintle progressively expanding the flow gradually into the duct downstream of the nozzle and pintle to minimize flow losses and maintain sonic flow in the nozzle, the relative movement between the nozzle and pintle providing varying converging-diverging annular flow areas between the nozzle and pintle, the nozzle and pintle being so contoured and proportioned as to impart sonic velocity to the flow through the nozzle over essentially the entire operating range of the engine manifold vacuum.

2. A control as in claim 1, the sonic flow metering means providing a number of constant flow levels corresponding to each open position of the valve means regardless of changes in engine speed and load.

3. A control as in claim 1, the actuator means including means sensitive to manifold vacuum level adjacent the valve means to proportion change in flow to a change in position of the valve means.

4. A control as in claim 1, in which the mass flow rate through the flow metering means varies only as a function of the flow area as determined by the position of the valve means.

5. A control as in claim 1, the actuator means including a servo mechanism having a movable force transmitting means connected to the valve means and actuated at times in response to and by changes in the level of the intake manifold vacuum acting on a portion of the nozzle.

6. A control as in claim 5, the actuator means including an on-off vacuum switch having a first vacuum input connected to a portion of the nozzle so as to be sensitive to changes therein, a second air input, an output connected to the servo mechanism, and other means responsive to engine operation for moving the switch means to the on position to connect vacuum to the servo mechanism to move the valve means to a more open position or move the switch means to an off position connecting air to the servo mechanism to effect movement of the servo mechanism to move the valve means towards a closed position.

7. A control as in claim 1, wherein the actuator means includes a pneumatically actuated servo.

* * * * *

UNITED STATES PATENT AND TRADEMARK OFFICE

CERTIFICATE OF CORRECTION

PATENT NO. : 3,981,283

DATED : September 21, 1976

INVENTOR(S) : Warren F. Kaufman

It is certified that error appears in the above-identified patent and that said Letters Patent are hereby corrected as shown below:

Claim 1, Column 6, line 14, change "piston" to -- position --;

lines 18-19, after "therebetween" insert -- between --;

line 19, change "pistons" to -- positions --.

Signed and Sealed this

Eleventh Day of November 1980

[SEAL]

Attest:

SIDNEY A. DIAMOND

Attesting Officer

Commissioner of Patents and Trademarks